United States Patent [19]

Ko et al.

[11] Patent Number: 4,895,620

[45] Date of Patent: Jan. 23, 1990

[54] ELECTRICALLY CONDUCTIVE CARBON-COATED FIBERS

[75] Inventors: Kenneth K. Ko; Nowaf Halout; Ronald S. Lenox, all of Lancaster, Pa.

[73] Assignee: Armstrong World Industries, Inc., Lancaster, Pa.

[21] Appl. No.: 49,822

[22] Filed: May 15, 1987

Related U.S. Application Data

[63] Continuation-in-part of Ser. No. 830,278, Feb. 18, 1986, abandoned.

[51] Int. Cl.[4] ..... D21H 3/78

[52] U.S. Cl. ..... 162/138; 162/146; 162/168.1; 162/169; 162/181.9

[58] Field of Search ..... 162/138, 169, 168.1, 162/146, 168.2, 181.1, 181.9, 181.3, 181.5

[56] References Cited

U.S. PATENT DOCUMENTS

| | | | |
|---|---|---|---|
| 2,328,198 | 8/1943 | Davenport et al. | 162/181.9 |
| 2,375,245 | 5/1945 | Pretzel | 162/169 |
| 2,563,897 | 8/1951 | Wilson et al. | 162/138 |
| 3,012,928 | 12/1961 | Whitman | 162/138 |
| 3,074,843 | 1/1963 | Lagally et al. | 162/181.5 |
| 3,149,023 | 9/1964 | Bodendorf et al. | 162/138 |
| 3,265,557 | 8/1966 | DeFries et al. | 162/181.9 |
| 3,269,889 | 8/1966 | Hutchins | 162/138 |
| 4,178,205 | 12/1979 | Wessling et al. | 162/168.1 |
| 4,225,383 | 9/1980 | McReynolds | 162/145 |
| 4,606,790 | 8/1986 | Youngs et al. | 162/181.9 |

FOREIGN PATENT DOCUMENTS

| | | | |
|---|---|---|---|
| 186699 | 10/1983 | Japan | 162/181.9 |

OTHER PUBLICATIONS

Casey, *Pulp and Paper,* 3rd Ed., vol. III, (1981), pp. 1603, 1604.

*Primary Examiner*—Peter Chin

[57] ABSTRACT

A composition is described which is prepared so that it has a low electrical resistivity so that it can be used in electrostatic discharge operations. The composition includes carbon-coated fibers. The fiber is characterized in that it is a Lewis base while the carbon powder is a Lewis acid. The carbon-coated fiber is held together with a binder (such as a latex or resin). The binder may be either neutral or acidic. A resin can also be used to prepare rigid electrostatic discharge objects. When a resin is used, the resin should also be neutral and preferably, is acidic.

31 Claims, No Drawings

ELECTRICALLY CONDUCTIVE CARBON-COATED FIBERS

This application is a continuation-in-part of U.S. application Ser. No. 830,278, now abandoned.

BACKGROUND OF THE INVENTION

Static control problems have been recognized for many years in the electronic industry. As the miniaturization of semiconductor devices progresses, the sensitivity of these devices toward electrical fields also increases. Static electrical charges are brought about by the movement of dissimilar materials against one another. Often, a static discharge of only a few hundred volts can damage a sensitive electronic chip, and yet, static electricity in excess of 30,000 volts can be accumulated on a human body simply from walking on a carpet. The need to prevent static charge generation requires that a total assembly environment be constructed of charge dissipative materials, and that all workers and equipment be connected to electrical common ground to prevent a build-up of static charge. Thus, there is a need for products that efficiently dissipate electrical charges.

It has been discovered that by coating carbon particles (powders) onto an organic fiber and subsequently calendering them into a paper felt or incorporating them into a plastic matrix, highly conductive materials that effectively dissipate charge can be provided. The instant materials, moreover, are more conductive at lower carbon concentration than other materials that are commercially available.

The instant invention provides conductive carbon-coated fibers and materials made therefrom which have a lower carbon concentration at resistivities of $1\times10^7$ ohms/square or lower using a carbon concentration of only a few percent.

Lowering carbon concentration but increasing conductivity advantageously results in a lower carbon consumption, and also provides such as carbon-filled paper which has lower slough value (a decrease in the number of particles that fall out of the paper). Lowering the particle drop rate allows this paper to be used in applications more sensitive to particle contaminates.

SUMMARY OF THE INVENTION

While several factors are discussed herein which allow the lowering of the carbon concentration but, simultaneously improving conductivity, a single important factor described herein involves the Lewis-acid: Lewis-base relationship of the carbon and the fiber. Widely available carbon powders used to prepare the instant conductive materials are slightly acidic. In accordance with the instant invention, the fiber selected must be a Lewis base. Thus, an acid-base interaction between the carbon and the fiber is established, which encourages and optimizes the coating of the fiber with the carbon.

With this combination, an aqueous slurry can be made by combining the acidic carbon powder, a basic fiber, and water; and even without the use of a binder or flocculant, a 99% by weight loading of carbon onto the fiber will be achieved.

It has also been discovered that conductivity can be even further increased by controlling the acid-base nature of the environment of the fiber and carbon particle. While conductive carbon-coated fibers and conductive articles containing such fibers can be prepared utilizing solutions and/or materials including a binder, a resin, a filler, a pigment, which are basic in nature, it has been found that better conductivity can be achieved by selecting such materials with a Lewis acid character or, at the most, neutral to acidic (cationic). If basic materials must be used, these should be less basic than the fiber.

Hence the other materials included in the instant compositions and the solutions and materials used during the preparation of the instant fibers and compositions should at least be neutral and preferably, should be acidic in order to obtain even higher conductivity.

When a binder is used in preparing the instant carbon-coated fibers, a flocculation process can be used, to improve mechanical properties, to stabilize bonding of the particle to the fiber, and binder retention. Flocculation, as used herein, refers to a process in which suspended or dispersed particles can be destabilized and agglomerated by using a chemical or chemicals known as flocculants. The binder is flocculated onto the carbon-coated fiber, thus stabilizing the carbon-fiber bond.

These carbon-coated fibers make a highly conductive carbon paper by calendering the carbon-coated fibers after the flocculation process.

For other embodiments, these fibers can be blended with resins to make conductive plastics. In such cases, the resins, fillers, binders, and other ingredients and any materials used in manufacturing such as aqueous solutions and solvents, in accordance with the instant invention are at least neutral, and preferably, should be acidic in order to refrain from interfering with carbon coating. In this manner, conductivity is optimized in accordance with the instant invention.

Additional factors which can be controlled for an improved product includes carbon particle size and the aspect ratio (length:diameter ratio) of the fiber. For best results, the size of the carbon particles is small, while the fiber is an aspect ratio is high.

Both the conductive carbon paper and the conductive plastic composition dissipate electrical charges effectively and are excellent materials for electrostatic discharge (ESD) applications.

DETAILED DESCRIPTION

To form the carbon-coated fibers of the present invention, a homogeneous aqueous slurry is formed of carbon powder, an optional binder, and the selected organic fiber. If no binder is to be used, the slurry can be drained, and the coated fibers used. The acid-base attraction of the carbon for the fiber will decrease carbon sloughing and aid in carbon retention.

If a binder is to be used, it is mixed in after the slurry of the fiber and carbon are formed. When the binder is used, it is preferred that a flocculant is also used. If an acidic binder is used particularly a cationic latex, the binder will tend to collect on the fibers without the use of a flocculant; thus a flocculant may be omitted in this instance. Even with an acidic binder, however, it is preferred to use a flocculant.

The flocculant is permissively added to the carbon-fiber slurry either before or after the binder. The slurry is well mixed and thereafter the consistency of the slurry an be adjusted, if desired to fall within the perferred range of about 0.5–5% solids. The slurry can be drained and the product collected.

While conductive fibers have been prepared using a slurry that is slightly basic (maximum pH of 9), it has been found that better carbon-fiber bonding and better conductivity is obtained when the slurry is neutral or acidic-(that is, a pH range from about 7.5 to about 3.5). Using such a slurry with basic fibers and the acidic carbon, fibers with about a 99% carbon retention (loading) and good conductivity is obtained even without the addition of a binder or a resin.

Basic environments caused by basic slurries and basic resins interfer with the acid-base attraction of the acid carbon and the basic fibers. These basic slurries and resins tend to compete with the basic fiber in attracting the carbon particles. Carbon particles which do not attach to the fibers are loose and do not allow optimization of conductivity. Although a neutral environment can be used, it is most preferred to adjust the pH of the aqueous slurry to an acidic value. A preferred acidic pH range is from about 3.5 to about 6.5. Either mineral acids or multivalent metal salts are most suitable for this adjustment. A preferred acid can thus be selected from the group consisting of: hydrochloric, hydrobromic, hydrofluoric, sulfonic, sulfurous, nitric and nitrous. The most preferred is hydrochloric. Preferred multivalent metal salts are aluminum salts, calcium salts and zinc salts.

Although 99% carbon retention is obtained without adding a retention aid (such as a flocculant) after the carbon is absorbed onto the fiber, the agitated slurry can be treated with a cationic metal salt such as calcium chloride, aluminum sulfate and zinc sulfate, or a cationic polyelectrolyte such as Kymene, a trademark of Hercules Company, for a quaternary ammonium chloride polyelectrolyte. The cationic material helps to acidify the environment and to improve carbon retention.

The cationic salt generally is used in the amount of about 5 to about 30 weight percent, based on the total weight of the formulation, exclusive of water. The cationic polyelectrolyte generally is used in an amount of from 0.01 to 4% by total weight, exclusive of the water. Basic chemicals can be added in a sufficient amount to the aqueous slurry after the flocculant is added, in order to bring the slurry to neutrality, if desired. Preferably, the base is a bicarbonate salt. If desired, a binder can also be added at this point instead of adding it before the flocculant. When a binder is added, retention aids or other flocculant must be used to flocculate the binder onto the carbon coated fiber. Alternatively, the carbon-coated fibers can be prepared and then combined with a binder and/or a resin at a later time, as needed to prepare paper, felt, or other articles.

It should be understood that the acid-base character intended herein is: The Lewis acid is an electron acceptor. The Lewis base (a base) is an electron donor. In principle, all elements and compounds can be characterized as acid, basic or neutral using this concept. More information on this subject can be obtained from articles such as: "Acid-base Interaction to Polymer-filled Interactions" by Frederick M. Fowkes, *Rubber Chemistry and Technology*, Volume 57; No. 2, May–June, 1984; and "The Concept of Lewis Acid and Bases Applied to Surfaces" by P. C. Stair in the Journal of the American Chemical Society, 1982. As the article by Fowkes indicates, the tendency to build a positive charge and become an electron acceptor makes a substance a Lewis acid. Similarly, a Lewis base tends to build a negative charge. The strength of the base or acid can be measured as a chemical potential. A Lewis base has a negative chemical potential. The details of such measurement can be found in Fowkes publications.

The best combination of the instant invention combines basic fibers with acidic carbon powders; an acidic slurry is used (6.5–3.5 pH) optionally including acidic binders and/or resins.

The carbon-coated fibers obtained can be dried such as by first draining off the water using a vacuum handsheet-mold and subsequently even drying the fibers. The dried carbon-fiber may be lightly beaten, such as in a Waring blender, to obtain the loose carbon-coated fibers. Otherwise, the carbon-fiber material can be pressed and hot calendered to form a dried carbon paper.

Since conductivity depends on the carbon adhering to the fiber, as little agitation as possible should be used both during and after the preparation of the carbon-coated fibers. It is thus preferred that during preparation of the carbon-coated fibers, agitation does not exceed 15 minutes and preferably, it should not exceed 10 minutes. When agitation is needed, either during preparation of in further processing of the carbon-coated fibers into other products; preferred apparatus includes the blade mixer and the two roll mill. As previously indicated, these should preferably not be used for more than 15 minutes and most preferably, for less than 10 minutes.

Paper may be formed in a conventional way by feeding the slurry to a paper-forming machine, such as a Fourdrinier, cylinder machine, wet machine, or the like for forming into fibrous sheets. The sheet will be dried in normal fashion.

The fibers which can be utilized in the present invention must be basic. Included among such fibers are cellulosic fibers. Preferred cellulosic fibers are sulfite pulp, kraft pulp, soda pulp, cotton aids, cotton linters, rags, newspaper pulp, and regenerated cellulose.

Basic polymeric materials can be used for the basic fibers. One preferred type of basic fibers are polymeric materials having anionic moieties. Preferably, basic fibers are composed of materials selected from the group consisting of: polyamides, polyesters, polyacrylates, poly methacrylates, polyethers, polyvinylacetates, polyacrylonitriles, polycarbonates, polyethyl acetates, polylactones, and polyvinyl alcohol.

The interrelationship of the fiber length and carbon particle diameter is important for optimizing conductivity. The average minimum fiber length, preferably, is about 2 times the average diameter of the carbon particle. Since longer fibers and (consequently) higher aspect ratios are preferred, the maximum fiber length is determined by practicality, ease of handling, and intended use. While any length fiber can be used, a convenient length is 30 mm or less. Preferably, the average fiber length is less than 15 mm, and most preferably, it is less than 5 mm. Since the diameter of the fibers used can be quite small, the average aspect ratio (length: diameter) of the fibers can have an extremely high value. The fiber's average aspect ratio range can be from about 10,000 to about 1.

The amount of carbon used to prepare the instant fibers and fiber products can be determined by the amount of conductivity desired. Samples with useful end applications, preferably, have resistivities of from about $1\times10^2$ ohms/square to about $1\times10^7$ ohms/square. The carbon concentration for fibers with these resistivities ranges from about 2 to about 25% by weight of the coated fibers. The instant invention, by controlling the factors described herein, permits optimization of conductivity, allowing the conductivity level to be achieved using less carbon than commercially available products. The instant carbon coated fibers generally will not be required to be more than 30% by weight carbon at which point an increase in carbon does not appreciably improve conductivity. The minimum carbon concentration should be about 1% by weight of the carbon-coated fibers. The amount of the carbon-coated fibers used in materials such as papers, composites, and molded articles will likewise depend on the amount of conductivity desired. Broadly, the instant coated fibers can be utilized in an amount of from about 1 to about 99% by weight of the total product material; a more commonly utilized range is from about 20 to 99% by weight of the total material.

While binders give desirable physical properties such as flexibility and strength, using neutral or acidic binders improves the conductivity of the carbon-coated fibers. Thus, in order to lower resistivity, basic (anionic) binders must be avoided.

Respective concentrations of the materials, carbon and fiber (or carbon-coated fiber) and binder and resin, will depend on a variety of factors such as end use, and the particular materials selected. When a binder is used, the binder can acceptably be in an amount of from about 1 to about 35%, preferably from about 1 to 22% by weight of the total product material. Carbon can be used in an amount of from about 1 to about 30% by weight of the combined weight of fiber and carbon. An acceptable amount of fiber is from about 35 to about 98% by weight of the total product material. If desired, a resin can also be incorporated, preferably, in an amount of from about 1 to about 35% by weight of the total product material.

Carbon powders used with the invention to coat the basic-fiber, are acidic. Since the fiber must be basic, this sets up a Lewis acid-base interaction which aids in the coating of the fiber and in the adherence of the carbon thereto. It should also be noted that "sloughing" or the "slough value" of the resulting product is reduced. (Sloughing is the falling of the carbon off the paper or the fiber. The slough value, measured for either the fiber or the paper, is, therefore, the amount of carbon that falls off).

In preparing the instant carbon-coated fibers, conductivity can also be optimized by using smaller particle sized carbon powders. A suitable average particle size for the carbon is less than 75 nanometers (nm). A preferred size is less than 55 nm and most preferably, the average particles size is less than 30 nm.

As previously indicated, the binder used should not interfere with the acid-base attraction of the carbon for the fiber. Therefore, the binder should at least be neutral and preferably, the binder should be acidic. This will optimize conductivity. An acceptable acidic binder can be any cationic latex.

One way in which acidic binders can be produced (or neutral or less acidic binders can be further acidified) is by attaching acid moieties to binder materials by chemical reaction. A halogenated moeity, for example, will give the polymer an acidic site. Preferred groups which can be used for this are: a halogen, a quarternary ammonium, a quarternary sulfonium, a quarternary phosphonium, or mixtures thereof. Suitable sources of these are their respective salts. Reactions known in the art such as halogenation and quarternization can be used. These moieties can be included in polymers to acidify resins for incorporation with carbon-coated basic fibers.

Another source of acidic binders are materials that are acidic because of the nature of the emulsifying agent(s) which are used to disperse these materials into a suspended form. Emulsion polymers are preferred examples of such binders, and latexes are preferred examples of emulsified polymers. Emulsification using a cationic surfactant or emulsifying agent is thus another way to produce an acidic binder. Such binders are preferably added to the acidified bath after the carbon and fibers are combined. The binder is then flocculated around the carbon and fibers by using a flocculant.

Latexes, coloidal suspensions of polymer particles in water, are prepared either by emulsion polymerization or polymerized in solution and emulsified by dispersion techniques. The resulting latexes are cationic, non-ionic or anionic depending upon the charge characterization of the emulsifying agent or surfactants used in the preparation techniques. For the instant invention, the cationic or non-ionic emulsifying agents are desired, the most preferred material is cationic.

Some suitable polymer latexes are: styrenebutadiene (SBR); carboxylic SBR, carboxylated styrene butadiene acrylate; vinyl pyridine (styrene-butadiene vinyl-pyridine); methyl methacrylateacrylic esters (acrylic); butadieneacrylonitrile (NBR); chloroprene acrylonitrile (neoprene); vinyl acetate polymer (vinyl acetate-higher esters); copolymers of vinylidene chloride such as vinylidene chloride-acrylonitrile; polyisoprene; and polyisobutylene-isoprene. Some non-ionic surfactants which can be used for emulsifying polymers to make suitable latex binders are: nonylphenoxylpolyethoylethanol (Rohm & Haas (Triton N-401)); nonylphenol polyethylene glycol ether (Union Carbide Corp. (Tergitol NP-40)); dialkylphenoxy polyethylenoxy ethanol (GAF Corp. (Igepal DM-730)); sorbilan monolaurate (ICI American Inc. (Span 20)). Suitable cationic surfactants are: quarternary ammonium salt of urethane prepolymer (W. R. Grace and Co. (Aypol WB-4000)); hexadexcyltrimethyl ammonium bromide; and stearyl dimethylbenzyl ammonium chloride.

Other preferred binders are polymeric latexes which contain an acidic moiety such as halogen moieties. As previously indicated, preferred polymeric latexes can also include moieties selected from the group consisting of: a quarternary ammonium, a quarternary sulfonium, and a quarternary phosphonium.

In certain embodiments of the instant invention, a resin can be used. While resins can be used as a binder and will function as a binder, i.e. to hold the carbon-coated fibers thereby preventing carbon sloughing, and giving strength and flexibility; resins are also used in combination with the carbon-coated fibers in functions distinct from binders, especially the types of binders used for papers and felts. The resins provide body rigidity and other characteristics needed or desired for specific conductive plastic articles. When a resin is combined with a carbon-coated fiber and binder material, the use of a neutral or acidic resin is especially important when the binder is in low concentration (less than about 15% by weight). The use of the neutral or acidic resin protects the carbon-fiber contact.

The resin can be incorporated into the carbon fiber slurry before or during flocculation, or fiber mixture after draining of the aqueous solution. A fiber can also be combined with the carbon-coated fibers during process steps involved in the preparation of specific articles. Such articles include composites and other rigid molded articles. When the resin material is added to the slurry containing the carbon and fiber during flocculation, advantageously, a homogeneous mixture can be achieved without an additional mechanical mixing step. The resin-containing material can be press-cured in a mold to form structures with any desirable shape. The final structure can retain the conductivity of the felt containing the carbon-coated fibers without much breaking of the conducting path due to extensive processing operations.

Although it is possible to prepare conductive carbon-coated fibers with a basic resin, the resin must not be more basic than the fiber, and in fact, in order to lower resistivity and improve conductivity, the resin should not be basic at all. The resin should be neutral or acidic. Most preferably, the resin is at least as acidic as the carbon. When the resin is acidic and preferably more acidic than the carbon, the resin can not attract the carbon away from the fiber. Resins can thus be used with coated fibers alone and an improved conductivity achieved. Preferred acidic resins can be selected from the group consisting of: polyvinyl chloride, polyvinyl floride, polyvinylidine chloride, polyvinylidine floride, polyvinyl buteral, chlorinated polyethylene and chlorinated polypropylene. Resin material can also be made more acidic by incorporating the previously indicated moieties in the resin (a halogen, a quarternary ammonium, a quarternary sulfonium, a quarternary phosphonium).

The amount of resin used with the instant compositions will depend on factors such as the end use of the article, desired physical properties, etc. The use of resins can range from 1% to about 90%, allowing for wide applicability. A preferred resin concentration is from about 20% to about 80% by weight of the total material. The carbon-coated fibers can be used in an amount of from about 5 to about 75% by weight and preferably, in an amount of from about 7 to about 40% by weight of the total material.

When more resin is used, the resulting structure will tend to loose its felt-like appearance, although conductivity is still present. Rigid articles can be obtained by using resins, but conductivity is still maintained. For the less rigid (felt) articles, the resin concentration is maintained in the range of from about 2 to about 25% by weight.

The optimum weight ratio between the carbon content and the fibers depends upon the anticipated end applications of the carbon-coated fibers. When used as conducting papers having a desired resistivity of $10^2$ to $10^5$ ohms/square, the carbon content can be approximately from about 2 to about 22% by weight of the fiber content.

In another embodiment of the invention, a conductive carbon-coated fiber/polymer (resin) composite can be made such as by using either a molding or a milling process. When a molding process is used, the carbon-coated fibers and the polymer powder are first thoroughly mixed. The mixture is subsequently hot pressed to consolidate the composition. It is important to note that while a thorough mixing is essential to obtain a homogeneous mixture, too much agitation and shearing may break the carbon off from the fiber surface.

Both pellet or powder form polymers could acceptably be used in the milling process. Preferably, only powder or particulate polymers are used, since the pellets themselves cause unneeded agitation which damages the carbon-coated fibers and lowers conductivity. The carbon-coated fiber can be premixed with the resin before milling or mixed during the milling. A preferred resin particle size is about 100 microns or less. After the milling operation, the consolidated material, a homogeneous mixture in which the fibers are dispersed in the polymer, is hot-pressed into a sheet structure. Again, it should be cautioned that excess milling, as excess mixing, may have an adverse effect on the conducting properties of the composite because carbon powders may be sheared off of the fiber surfaces. Thus, this milling action should be held to a minimum, preferably, less than 15 minutes and most preferably, less than 10 minutes.

If desired, an inorganic filler may be included in the instant compositions. The fillers may be either neutral or acidic, but preferably, they are acidic. Inorganic fillers which are not inherently acidic may be made acidic by incorporating chemicals containing a silane functional group onto the surface of the filler. Preferred acidic fillers can be selected from the group consisting of: silica, acidic clay, acidic glass, silanol, and iron oxide.

The following examples are intended to illustrate the instant invention and should not be taken to limit it.

EXAMPLE 1

The effect of the pH of the bath in which in regard to the carbon-coated fibers are prepared the conductivity of the carbon-coated fiber is demonstrated in Part A, B and C of this Example.

Part A 2.0 grams of carbon having an average particle size of 24 nm. and a surface area of about 250 $m^2$ per gram and 38.0 gm of an unbleached soft wood-pulp fiber having a fiber length of 0.4–1.6 mm and a diameter of 16–60 nm was mixed with 700 cc of tap water that had an adjusted pH of 10.0 (pH was adjusted with 3.0% $NH_4OH$ solution). These ingredients were mixed in a Warren blender at high speed for 30 seconds. The mixed slurry was then transferred to a container and water was added until the total volume of the slurry reached 2,500 cc (% solids of 1.6). The pH of the slurry was readjusted to maintain a pH of 10. The mixture was stirred for an additional 30 second period and then the slurry was drained to form a handsheet. The handsheet sample was further dried by pressing the sample in a press set at 600 psi pressure for 30 seconds followed by running the handsheet through a roll dryer set at 230° F. until the handsheet sample was totally dry. The carbon paper formed this way had a retention (final weight/total ingredient weight$\times$100) of better than 99% and the surface resistivity measured directly after the drying was $9.0\times10^4$ ohm/square. The sample was subsequently conditioned at 50% relative humidity for 48 hours. The surface resistivity was then measured after this conditioning and the new surface resistivity was $5.6\times10^4$ ohm/square.

Part B

In a separate experiment, another carbon paper handsheet sample was prepared according to the procedure described in Part A except that the pH of the slurry was maintained at 7.0 using a 3% ammonium hydroxide and a 3% hydrochloric acid solution for adjustment. After drying the sample, the retention of the handsheet was found to be better than 99%. The surface resistivity measured right after the drying of the sample was $8.4\times10^4$ ohm/square. After conditioning this handsheet sample at 50% relative humidity, the handsheet had a surface resistivity of $4.6\times10^4$ ohm/square, showing a slightly better conductivity than the sample prepared under Part A.

Part C

Using the same procedure in another experiment, the carbon paper hand-sheet was prepared with a pH of the slurry being adjusted to 4.5 using a 3% hydrochloric acid solution. The dried handsheet again had a retention better than 99%. The surface resistivity of the hand-sheet measured after the drying was $2.8\times10^4$ ohm/-square. After conditioning at 50% relative humidity, the carbon paper had a surface resistivity of $1.7\times10^4$ ohm/square, showing a conductivity better than both Parts A and B.

Part A, B and C above of this example demonstrates how the pH of the environment during carbon fiber preparation affects the conductivity. Under Part C, the flocculation bath and slurry which was maintained at an acid pH. The resulting carbon-coated fiber was superior in conductivity. In a basic environment, this environment competes with the basic fiber in interacting with the carbon. As a result, the carbon powder either is not depositing tightly onto the fiber surface or less carbon is deposited on the fiber. This results in a carbon paper with higher resistivity (less conductive). In contrast to this, when the slurry was acidic, the environment was not competing with the fiber in interacting with the carbon. The resulting fiber thus was lower in resistivity (more conductive).

EXAMPLE 2

This Example demonstrates the effect of the acid-based characteristic of the resin on the conductivity of the carbon-coated fiber/polymer composition.

Three polymer resins were selected for this experiment. They included: a PVC resin (polyvinyl chloride) (acidic), a low density polyethylene resin (neutral), and a PMMA (polymethyl methacrylate) (basic), all in powder form. 50 grams of the resin powder and 6 grams of the carbon paper were used in preparing the composite. The carbon powder used in making the paper was the conductex 975 (Columbian Chemical Company). The pulp fiber of the paper is an unbleached soft pulp (cellulosic), and the paper was made to contain 25% carbon in the structure. In other words, the carbon content of the final polymer composite containing the carbon paper was about 2.6%.

In preparing the carbon paper, the pulp fiber was mixed with the carbon powder for one minute using a Waring blender to form a homogeneously slurry. The slurry was then transferred into a bath and while continuing the agitation of the slurry, a small amount of alum was added to improve retention of the carbon particles on the fiber.

The slurry was then drained, and the fibers collected. The carbon-coated fibers were dried without being pressed.

To make resin material from the above-prepared fibers, 10 parts by weight of the fibers in loose sheet form were blended with 120 parts of the polymeric resin. A Waring blender was used until the two components were well mixed (approximately 45 seconds). The mixture was then molded by hot-pressing at about 320° F. for 5 minutes.

The surface resistivities of the samples were measured according to the ASTM Method D-257. A gold plated electrode assembly consisting of an inner electrode in the shape of a round disk, and an outer electrode in the shape of a washer (i.e., the guarded-ring electrodes) was placed on the surface of the sample to be measured. To enhance the contact between the sample surface and the electrode, a 5-lb weight was placed on top of the electrodes. When the measurement started, a 500 DC voltage was applied to the inner electrode. The corresponded resistivity measured on the surface of the specimen was read using the General Radio 1644-A Megaohm Bridge. The resistivity, multiplied by the instrumental constant which was calculated based upon the geometry of the electrodes, gave the resistance of the specimen.

The surface resistivities of the three carbon fiber/-polymer composites were given below.

PMMA (basic): $1.44\times10^5$ ohm/square
PVC (acidic): $1.24\times10^4$ ohm/square
Polyethylene (neutral): $2.2\times10^4$ ohm/square

EXAMPLE 3

The example compares carbon-coated fibers having in (A) a cationic (acidic) binder to carbon-coated fibers having in (b) and (c) an anionic (basic) binder and (c).

Part A 2.04 grams of carbon powder (Conductex® 975, Columbian Chemical Company) and 36.7 grams of unbleached soft-wood pulp materials were mixed with 1000 cc. water in a Waring blender (Fisher Scientific, Model #14-509-7C), After mixing in the blender for one minute at low speed, the slurry mixture was transferred to another container. An additional 2000 cc. of water was added to the mixture. Continuous agitation was applied to the slurry mixture using a rotary mechanical mixer. After the slurry was well mixed (about 60 seconds), 2.04 grams of a cationic acrylic-ester copolymer latex was added to the slurry. The deposition of the cationic latex onto the carbon/pulp fiber surface occurred in less than 30 seconds as evidenced by the clarity of the supernatent solution. If desired, however, a flocculant such as aluminum sulfate (suitably from 0.5 to 3 grams) might be optionally added to the slurry mixture at this point to ensure a completely flocculation of the latex. Although this was not necessary for the cationic binder. After draining off the water and drying the carbon-coated fiber prepared in a paper form, the carbon-coated fiber had a surface resistivity of $4.0\times10^4$ ohms/square.

Part B

Another sample was prepared using exactly the same composition except that the latex was an anionic SBR latex (styrene to butadiene ratio was 45 to 55). 2.0 grams of aluminum sulfate was used to flocculate the latex. Without the aluminum sulfate, the slurry remained cloudy. Thus, for anionic binders, a flocculant is required. After drying the carbon-coated fiber, the surface resistivity of the fiber was $1.1\times10^5$ ohms/square.

Part C

A further sample was prepared using the same composition formulation except that the binder was a starch dispersed in water (the starch particle was negatively charged (anionic)). 2.0 grams of aluminum sulfate was used to flocculate the starch dispersive particles. After drying, the carbon-coated fiber, the surface resistivity was $9.0\times10^5$ ohms/square.

EXAMPLES 4–10

These examples illustrate the effect of carbon concentration on the conductivity of the paper made from carbon-coated fibers prepared according to the procedure described in Example 3. In this example, a sheet was made using the following formulation:

Newspaper Pulp 37.9 parts
SBR Latex 0.82 parts
(Styrene/Butadiene Rubber, Hycar 2671)
(Hycar 2671 from B. F. Goodrich)
Carbon Black 2.86 parts
(Conductex 975 from Columbian Chemicals Co. 24 nm in diameter)
Alum (aluminum sulfate) 4.2 parts
Sodium Bicarbonate 60 cc of a 1M solution
Water 2,200 cc

Procedure

The newspaper (in pulp form) was first mixed together with the carbon powder for 1 minute using a Waring blender to form a homogeneously mixed slurry. (This permits the carbon to become attached to the fiber).

The slurry was then transferred to another container. While continuing the agitation of the slurry, the alum was added. Enough sodium bicarbonate (approximately 60 ml of a 1M solution) was added to neutralize the slurry (pH=7 to 7.5). The latex was then introduced and the slurry was kept on agitating for another 2 to 3 minutes until the bath was cleared. The precipitated slurry was then drained in a handsheet-mold and subsequently oven-dried at approximately 200° F. using a roll-drier.

Examples 5 to 10 were made using the procedures of Example 4, except that the concentration of carbon powder varied as indicated.

The surface resistivities of the samples were measured according to the ASTM Method D-257 as described in Example 2.

The resistivity of the carbon papers prepared according to the invention are set forth below in Table I:

TABLE 1

| Example | % Carbon | Rs (ohms/sq) |
|---|---|---|
| 4 | 3 | $1.3 \times 10^{12}$ |
| 5 | 4 | $6.2 \times 10^{9}$ |
| 6 | 5 | $9.0 \times 10^{5}$ |
| 7 | 7 | $8.9 \times 10^{4}$ |
| 8 | 10 | $3.5 \times 10^{3}$ |
| 9 | 15 | $1.2 \times 10^{3}$ |
| 10 | 25 | $6.5 \times 10^{1}$ |

The results in this study demonstrated efficiency in dispersing and attaching carbon particles to fibers with basic characteristics such as the cellulose fibers used. This technique lowers the carbon content required to make the paper conductive. This illustrates the invention's utility in ESD applications. For example, conductive papers with lower carbon content would be applicable in combating the dust contamination problem which confronts the electronic industry.

EXAMPLES 11–22

These examples illustrate the mechanical properties of papers as made with different carbon-coated fibers and binders. All these papers were made according to the procedures set forth for Examples 4–10 with the exception that the binders and/or fibers varied as indicated. All the samples contained a 5% carbon content. The fibers used in Examples 11–16 were cellulose newspaper pulps. Examples 17 to 20 did not contain a binder, and, in addition, contained ratios by weight of cellulose secondary kraft pulp (L) to newsprint (S) as indicated. Examples 21 and 22 contained 5% SBR latex binder. Table 2 shows the mechanical properties of these samples.

TABLE 2

| Example | Caliper (in) | Binder |
|---|---|---|
| 11 | 0.044 | SBR (5%) |
| 12 | 0.048 | SBR (10%) |
| 13 | 0.047 | SBR (15%) |
| 14 | 0.041 | Starch (5%) |
| 15 | 0.037 | Starch (10%) |
| 16 | 0.035 | Starch (15%) |
| 17 | 0.038 | L/S = 4/1 |
| 18 | 0.039 | L/S = 3/2 |
| 19 | 0.042 | L/S = 2/3 |
| 20 | 0.038 | L/S = 1/4 |
| 21 | 0.036 | L/S = 5/0 (5%) |
| 22 | 0.037 | L/S = 2.5/2.5 (5%) |

Comparing the properties or papers made with different binders, those made with SBR latex are more flexible than papers with starch binders or with no binders. The tensile strength of the SBR carbon paper, on the other hand, is weaker than the others. The starch bound carbon papers appear to be much stiffer than other papers and are also higher in tensile and burst strengths. When the secondary kraft pulp was used together with the newsprint in the carbon paper, the secondary kraft pulp not only enhences the tensile strength of the paper, it also makes the paper more bendable with higher burst and tearing strength.

EXAMPLE 23

The formulation and the procedure of Example 4 was followed, with the exception that the alum and sodium bicarbonate were replaced with 10 cc of a 5% aqueous polyamine (Kymene) solution (i.e., a mixed solution of 21 cc 3% NaOH for neutralization and 50 cc 5% of Kymene, a cationic polyelectrolyte from Hercules Incorporation) and 4.0 parts of carbon black were used. After consolidating and drying the handsheet structure, the surface resistivity of the handsheet was $4.6 \times 10^{4}$ ohms/square.

EXAMPLES 24–31

These examples illustrate the preparation of composite materials comprised of carbon-coated fibers made according to the present invention and polyethylene resins (which are neutral).

To make the composite material of Example 24, a carbon-coated fiber was made utilizing the following formulation:

| | |
|---|---|
| Conductex 975 (24 nm) Carbon Black | 10.2 parts |
| Starch (National Starch Co.) | 4.08 parts |
| Newspaper Pulp | 26.52 parts |
| Alum | 4.2 parts |
| Sodium Bicarbonate (1 molar) | 60 cc |
| Water | 2200 cc |

The procedure of Example 4 was followed, with the exception that the thus prepared fibers were dried without being pressed.

To make the composite material from the above-prepared fibers, 10 weight parts of the fibers, in loose sheet form, were blended with 120 weight parts of HDPE powder (Arco Chemical Co.'s Super Dylan Powder Type SDP-750) using a Waring blender until the two components were well mixed (approximately 45 seconds). The mixture was then molded together by hot pressing at 320° F. for 5 minutes. The composite materials of Examples 25–31 were made using essentially the same procedure as Example 24, with the exception that the amount of carbon-coated fibers (shown as percent by weight) and thus the net amount of carbon in the composites (again shown as percent by weight) varied. In Examples 25–28, high density polyethylenes (neutral) were used; in Examples 29–31 low density polyethylenes (neutral) were employed. The results are set forth in Table 3.

TABLE 3

| Example | % Carbon-coated Fibers | Net Carbon | Surface Resist (ohms/sq) |
|---|---|---|---|
| 24 | 7.7 | 1.9 | $1.1 \times 10^6$ |
| 25 | 14.3 | 3.5 | $6.1 \times 10^4$ |
| 26 | 22.0 | 5.5 | $4.0 \times 10^4$ |
| 27 | 31.0 | 7.7 | $1.1 \times 10^4$ |
| 28 | 37.5 | 9.3 | $1.1 \times 10^3$ |
| 29 | 22.0 | 5.5 | $3.5 \times 10^4$ |
| 30 | 31.0 | 7.7 | $4.5 \times 10^3$ |
| 31 | 37.5 | 9.3 | $1.7 \times 10^3$ |

EXAMPLES 32–37

These examples illustrate forming composite materials using various organic fibers. In all these examples, the procedures used in Example 24 was essentially followed, except that at least one of (a) the percent carbon-coated fibers, (b) the net percent carbon and (c) the type of fiber used varied. In all examples high density polyethylene was employed. The surface resistivities of these composites is set forth in Table 4. HDPE is high density polyethylene.

TABLE 4

| Example | Fiber | Surface Resistivity (ohms/sq) | % Net Carbon | Lewis Acid-Base Characteristic of the Fibers |
|---|---|---|---|---|
| 32 | Polyamide (Kevlar ®) HDPE | $7.1 \times 10^7$ | 1.9 | basic |
| 33 | Polyamide/HDPE | $4.0 \times 10^4$ | 3.5 | basic |
| 34 | Polypropylene/HDPE | $10^{12}$ | 1.9 | neutral |
| 35 | Polypropylene/HDPE | $10^{12}$ | 3.5 | neutral |
| 36 | Cellulose/HDPE | $1.1 \times 10^6$ | 1.9 | basic |
| 37 | Cellulose/HDPE | $6.1 \times 10^4$ | 3.5 | basic |
| 38 | Polyester/HDPE | $5.2 \times 10^8$ | 3.5 | basic |

EXAMPLE 39

Parts a, b, and c given in this example further illustrate and importance of the acid-base characteristic of the environment in affecting the deposition of the acidic carbon particles on the basic organic fibers.

Part A 36.0 grams of unbleached soft-wood pulp materials were blended in a Waring blender with 1000 cc water at low speed for one minute. The slurry was transferred to another container. An additional 2000 cc of water was added to the slurry while continuous agitation was applied to the system using a rotary mechanical mixer. About 2.0 grams of alum (aluminum sulfate) was added to the slurry. The agitation action continued until all powder alum completely dissolved in the aqueous solution. The pH of the slurry at this point was (i.e. an acidic slurry) 2.0 gram of conductex 975 carbon powder (Columbian Chemical Co.) was introduced to the agitating slurry mixture. After mixing for 30 seconds, 2.0 grams of an anionic SBR latex (styrene/butadiene=45/55) was added to the mixture. Agitation continued until the latex was completely flocculated and the supernatant solution was clear. After draining off the water and drying the carbon-coated fiber was prepared in a paper form and its conductivity measured. This carbon-coated fiber paper had a surface resistivity of $2.0 \times 10^4$ ohms/square.

Part B

The same formulation was used in this experiment except that after preparing the wood pulp slurry, the anionic latex was added and the slurry was agitated to prevent the latex from settling and/or conglomerating onto the fibers. The carbon powder was then added and the alum was added last in the sequence. The pH of the bath after adding the SBR latex was 9.3 to 9.6 (i.e. a basic environment). When the carbon was introduced at this point, the latex particles tended to compete with the basic pulp fibers in interacting with the carbon particles. A paper was prepared from the fibers in the same manner as the fibers of Part A. The final carbon-coated fiber paper had a resistivity of $4.6 \times 10^4$ ohms/square.

If the alum had not been added, conductive coated fiber would have been obtained after agitation was stopped, and the fibers carbon and latex were either collected or permitted to settle. In this instance, the alum insured a complete carbon loading and latex flocculation and permitted a more precise comparison.

Part C

The same composition and processing sequence as experiment 6 were used in this experiment except that a cationic latex (acrylic-ester copolymer) was used instead of the anionic SBR latex. The pH of the slurry after adding the cationic latex was 5.5 as indicated in Part A, the fibers were prepared in paper form. The resistivity of the final carbon-coated fiber paper was $1.6 \times 10^4$ ohms/square.

This example demonstrates that in an acidic environment, the carbon particles interact better with the basic pulp fiber surface resulting in a carbon-coated fiber with higher conductivity. When the slurry is basic (experiment b), the interaction between the acidic carbon powder and the basic pulp fiber is interferred by other basic elements in the environment, the resulting carbon-coated fiber is less conductive.

We claim:

1. A composition having a low electrical resistivity comprising:

(a) fiber having (b) a carbon powder coating and (c) a binder which holds the fiber with the carbon powder coating wherein (a), (b) and (c) are characterized as follows in Lewis acid-base activity: the fiber is basic, the carbon powder is acidic and the binder is either neutral or acidic.

2. The composition of claim 1 wherein the binder is a latex that was acidic when it was combined with the fiber and carbon powder.

3. The composition of claim 1 wherein the binder was an emulsified polymer which was acidic when it was combined with the fiber and carbon powder.

4. The composition of claim 3 wherein the emulsified polymer is prepared from polymeric material selected from the group consisting of: styrene butadiene, carboxylic styrene butadiene, carboxylic styrene butadiene acrylic acid, styrene butadiene vinyl pyridene, methylmethacrylate acrylic esther, butadiene acrylonitrile, chloroprene acrylonitrile, vinyl acetate, vinyl idiene chloride, vinyl idiene acrylonitrile, polyisoprene, and polyisobutalyene-isoprene.

5. The composition of claim 1 wherein the fiber is composed of material selected from the group consisting of: polyamides, polyesters, polyacrylates, polyethers, polyvinyl acetates, polyacrylonitriles, polycarbonates, polyethyl acetates, polylactones, and polyvinyl alcohol.

6. The composition of claim 4 wherein the fiber is composed of material selected from the group consisting of: polyamides, polyesters, polyacrylates, polymethacrylates, polyethers, polyvinyl acetates, polyacrylonitriles, polycarbonates, polyethyl acetates, polylactones, and polyvinyl alcohol.

7. The composition of claim 3 wherein the fiber is composed of material selected from the group consisting of: polyamides, polyesters, polyacrylates, polymethacrylates, polyethers, polyvinyl acetates, polyacrylonitriles, polycarbonates, polyethyl acetates, polylactones, and polyvinyl alcohol.

8. A composition as described in claim 3 wherein the fiber is a polyamide.

9. A composition as described in claim 5 wherein the binder is a cationic acrylic ester copolymer latex.

10. A composition as described in claim 9 wherein the carbon powder coating is in an amount of from about 2 to about 22% by weight of the fiber.

11. A composition having low electrical resistance comprising:

A mixture of (a) fiber having (b) a carbon powder coating and (c) a rigid resin in particle form with the fiber with the carbon powder coating, wherein (a), (b) and (c) are characterized as follows in Lewis acid-base activity: the fiber is basic, the carbon powder is acidic and is held to the fiber by an acid-base interaction, and the resin is either neutral or acidic, further providing that the resin is a polymer that will form a rigid structure if the mixture is hot-pressed.

12. A composition as described in claim 11 wherein the resin is selected from the group consisting of: polyvinyl chloride, polyvinyl fluoride, polyvinylidene chloride, polyvinylidene fluoride, polyvinyl buteral, chlorinated polyethylene, and chlorinated polypropylene.

13. A composition as described in claim 11 wherein the fiber is composed of a material selected from the group consisting of: polyamides, polyesters, polyacrylates, polymethacrylates, polyethers, polyvinyl acetates, polyacrylonitriles, polycarbonates, polyethyl acetates, polylactones, and polyvinyl alcohol.

14. A composition as described in claim 11 wherein the carbon powder has an average particle size less than 55 nm.

15. The composition of claim 12 wherein the fiber is composed of a material selected from the group consisting of: polyamides, polyesthers, polyacrylates, polymethacrylates, polyethers, polyvinyl acetates, polyacrylonitriles, polycarbonates, polyethyl acetates, polylactones, and polyvinyl alcohol.

16. A composition as described in claim 11 wherein the resin is a powder having a particle size of about 100 microns or less.

17. A composition as described in claim 16 wherein the fiber is a polyamide.

18. A composition as described in claim 17 wherein the carbon powder has a particle size less than 55 nm.

19. A composition as described in claim 18 wherein the resin is polyvinyl chloride.

20. A composition as described in claim 11 wherein the carbon powder coating is in an amount of from about 2 to about 25% by weight of the fiber.

21. A composition as described in claim 17 wherein the carbon powder coating is in the amount of from about 2 to about 25% by weight of the fiber.

22. A method for the preparation of an electrically conductive fiber mixture consisting essentially of: combining water, basic fiber, an electrically conductive acidic carbon powder, and an acidic binder in an agitated slurry wherein, the basic fibers become coated with the acidic carbon powder, thereby forming a conductive fiber mixture, and wherein the acidic binder collects to hold the conductive fiber mixture, thereby becoming a part of the conductive fiber mixture, and then collecting the conductive fiber mixture.

23. A method as described in claim 22 wherein the binder is a cationic latex.

24. A method as described in claim 23 wherein the fiber is a polyamide.

25. A method as described in claim 23 wherein the cationic latex is a cationic acrylic-ester copolymer.

26. A method as described in claim 24 wherein the cationic latex is a cationic acrylic-ester copolymer.

27. A composition comprising a rigid, molded article of: a resin, and fiber having a carbon powder coating wherein the resin, the fiber, and the carbon powder coating are characterized as follows in Lewis acid-base activity: the fiber is basic, the carbon powder is acidic and the resin is acidic, and wherein the fiber and the carbon powder coating provide electrical conductivity to the article, and rigidity is provided by the resin.

28. A composition as described in claim 27 wherein the fiber is a polyamide.

29. A composition as described in claim 25 wherein the resin is a polyvinyl chloride.

30. A composition as described in claim 27 wherein the carbon powder coating on the fiber is in an amount of from about 2 to about 25% by weight of the fibers.

31. A composition as described in claim 29 wherein the carbon powder coating is in an amount of from about 2 to about 25% by weight of the fiber.

* * * * *

UNITED STATES PATENT AND TRADEMARK OFFICE

CERTIFICATE OF CORRECTION

PATENT NO. : 4,895,620

DATED : January 23, 1990

INVENTOR(S) : Kenneth K. Ko et al

It is certified that error appears in the above-identified patent and that said Letters Patent is hereby corrected as shown below:

In the Specification, in column 9, line 60, the words "10 parts by weight of" should be deleted, and line 61, the words "120 parts of" should be deleted.

In the Claims, claim 29 at column 16, line 53, the number "25" should be --28--.

Signed and Sealed this

Eighth Day of January, 1991

*Attest:*

HARRY F. MANBECK, JR.

*Attesting Officer*

*Commissioner of Patents and Trademarks*